US007992738B2

(12) United States Patent
Gao et al.

(10) Patent No.: US 7,992,738 B2
(45) Date of Patent: Aug. 9, 2011

(54) PALLET CONTAINER

(75) Inventors: Xiang Gao, Tianjin (CN); Jianping Li, Tianjin (CN)

(73) Assignee: China International Marine Containers (Group) Co., Ltd., Shenzhen (CN)

( * ) Notice: Subject to any disclaimer, the term of this patent is extended or adjusted under 35 U.S.C. 154(b) by 1176 days.

(21) Appl. No.: 11/422,818

(22) Filed: Jun. 7, 2006

(65) Prior Publication Data

US 2006/0278637 A1 Dec. 14, 2006

(30) Foreign Application Priority Data

Jun. 10, 2005 (CN) ..... 2005 1 0011912

(51) Int. Cl.

| | |
|---|---|
| ***B65D 6/28*** | (2006.01) |
| ***B65D 8/18*** | (2006.01) |
| ***B65D 1/42*** | (2006.01) |
| ***B65D 6/34*** | (2006.01) |
| ***B65D 8/08*** | (2006.01) |
| ***B65D 21/00*** | (2006.01) |
| ***B65D 85/62*** | (2006.01) |
| ***B65D 19/00*** | (2006.01) |

(52) U.S. Cl. ..... 220/4.27; 220/4.26; 220/647; 206/505; 206/512; 206/513; 206/600

(58) Field of Classification Search ..... 220/6, 426, 220/427, 475, 4.26, 4.27; 206/512, 513
See application file for complete search history.

(56) References Cited

U.S. PATENT DOCUMENTS

| | | | | |
|---|---|---|---|---|
| 3,981,410 A * | 9/1976 | Schurch | ..... | 220/6 |
| 4,186,841 A * | 2/1980 | Buckley et al. | ..... | 220/6 |
| 6,691,885 B2 * | 2/2004 | Brown | ..... | 220/7 |

* cited by examiner

*Primary Examiner* — Anthony Stashick
*Assistant Examiner* — Andrew T Kirsch
(74) *Attorney, Agent, or Firm* — Workman Nydegger

(57) ABSTRACT

A pallet container is used to transfer loose cargoes including frame members. The frame member has a rail connected to two posts. Each post is mounted with a nesting. The pallet container has a base frame which is formed by beams; a pair of first side frames and a pair of second side frames respectively formed by the base frame and post members of the invention. Each post member comprising a first post, provided at a corner of the base frame; a second post, spaced from the first post and mounted to the base frame by a reinforced plate, in which a cavity is provided. The pallet container equipped with the post member can be stable to load the frame member by inserting the second post of the present invention into the post of the loaded frame member.

9 Claims, 7 Drawing Sheets

PALLET CONTAINER

FIELD OF THE INVENTION

The present invention relates to a pallet container, and more particularly to a pallet container for transportation loose cargoes including frame members.

BACKGROUND OF THE INVENTION

A conventional pallet container as a modern transport tools is already used widely to transfer cargoes. Not only is the pallet container simplified in structure, but also convenient for loading or unloading cargoes. However, the conventional pallet container is not proper to transfer frame member 60, as shown in FIG. 1A. Such a frame member 60 of the prior art has a post 61; a folding post 63; and a rail 64 connected to two posts 61. The frame member 60 has a usage state and a folded state respectively. The folding post 63 and the post 61 are needed to assemble together when the frame member 60 takes part in transportation, i.e., the usage state; otherwise, the folding post 63 may be folded onto the rail 64, i.e., the folded state as shown in FIG. 1B, in order to save a storage space. Obliviously, the nesting 611 is formed on a top of the post 61 and is used to guide the assembly by inserting into the folding post 63, and the nesting 631 is formed on a top of the folding post 63 and is used to guide the stack one by one by inserting into another post 61. However, in the folded state, the center distance L2 of the two post 61 and a predetermined height H1' from the rail 64 to a bottom of the post 61 is also a large size for the storage. Thereby, it is inefficient to transport such loose cargoes. There are problems hard to deal with, such as it is difficult to be loaded and even hard to realized the stack.

SUMMARY OF THE INVENTION

An object of the present invention is to provide a post member comprising a first post, provided at a corner of a base frame; a second post, spaced from the first post and mounted to the base frame by a reinforced plate, in which a cavity is provided.

Another object of the present invention is to provide a pallet container for transportation loose cargoes that comprise at least frame members, each of which has a pair of posts spaced predetermined distance and nestings provided thereof. The pallet container comprises a base frame for loading cargoes, defined by longitudinal beams and crossbeams; two pairs of post members, provided at corners of the base frame, each of which comprising a first post, provided at a corner of the base frame; and a second post, spaced from the first post by a reinforced plate, into which the nesting is inserted; a pair of first side frames for supporting the frame member, provided at opposite sides of the base frame by the base frame and the first posts thereof; a pair of second side frames provided at another opposite sides of the base frame by the base frame and the first post thereof.

In accordance with one aspect of the present invention, it can be stable to load the frame member by inserting the second post of the present invention into the post of the loaded frame member. Furthermore, a polarity of frame members in the folded state can be provided along the second side frames. Hence, the pallet container of the present invention improves the amount of storage and can be rapidly stacked in a manner of efficiency.

In according to another aspect of the present invention, the pallet container of the invention can be also used to load with another loose cargoes to achieve a full usage by providing nets and baffles in the base frame and the first side frames to prevent the cargoes from falling off. Other objectives, advantages and novel features of the invention will become more apparent from the following detailed description when taken in conjunction with the accompanying drawings which do not limit the present invention.

BRIEF DESCRIPTION OF THE DRAWINGS

The appended drawings contain figures of preferred embodiments to further clarify the above and other advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENT

Figure 2A:
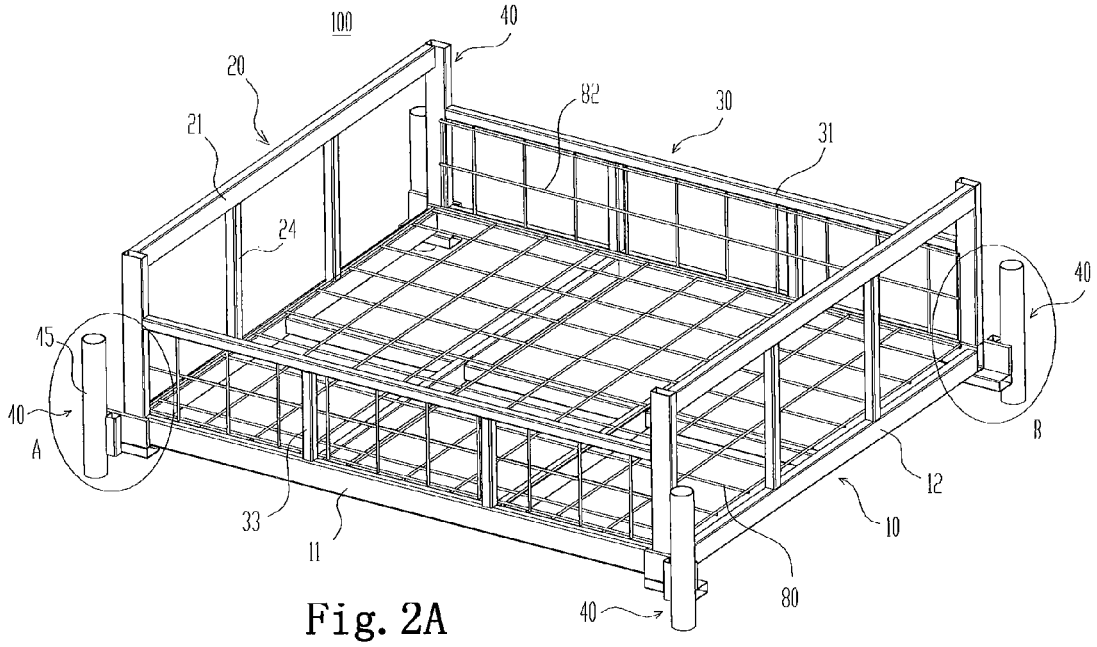
FIG. 2A is a perspective view of a pallet container in accordance with the present invention, showing a second post is provided at the corner of the base frame.

With reference to FIG. 2A, a pallet container 100 comprises a base frame 10, two opposed first side frames 20, and two opposed second side frames 30. The base frame 10 is defined by longitudinal beams 11 and crossbeams 12. The base frame 10 of the invention may be used for loading cargoes when a baffle 80 made of steel wires being provided on the base frame 10. Four post members 40 of the invention are respectively provided in four corners of the base frame 10 uprightly. Therefore, the two first side frames 20 can be formed at opposite sides of the base frame 10 by making use of the base frame 10 and the post members 40, thus the two second side frames 30 at another opposite sides. Each first side frame 20 has a crossbeam 21 formed transversely thereon and two crutches 24 longitudinally formed thereon to improve the intensity. Each second side frame 30 has a crossbeam 31 transversely formed thereon and two crutches 33 longitudinally formed thereon to improve the intensity. The second side frame 30 is provided with a baffle 82 for preventing the loaded cargoes from falling off the base frame 10. The baffle 80(82) can be made of steel, iron or other metals. Specially, the post member 40 of the present invention further comprises a first post 44 mounted on the base frame 10 and a second post 45 coupled to the first post 44.

Figure 2B:
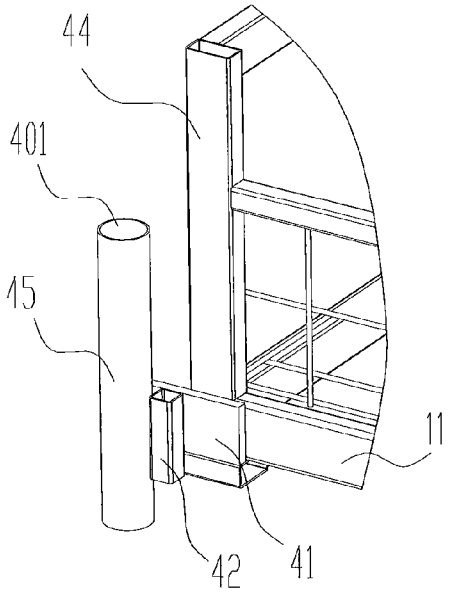
FIG. 2B is an enlarged perspective view of A part in FIG. 2A.
Figure 2C:
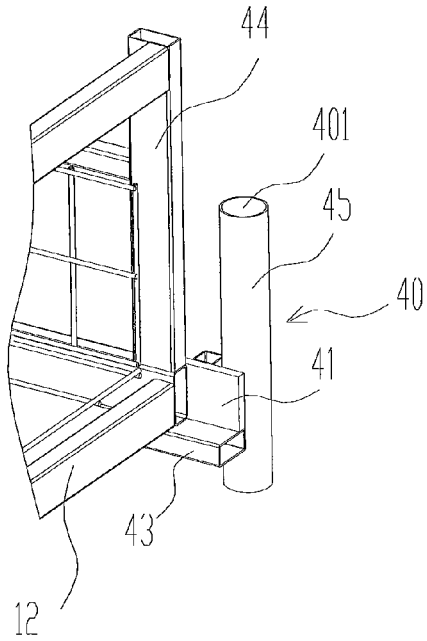
FIG. 2C is an enlarged perspective view of B part in FIG. 2A.

FIG. 2B and FIG. 2C show the post member 40 of the invention in details. The second post 45 is spaced from the first post 44 and further mounted to the base frame 10 by a reinforced plate 41, in which a cavity 401 is provided. The post member 40 can have a circular, square or other shape. In order to reinforce the second post, a reinforced support 42 is provided at one side of the reinforced plate 41 for coupling both the second post 45 and the reinforced plate 41. The reinforced support 42 is flush with the reinforced plate 41 for the demand of assembly. A corner support 43 is also provided at the other side of the reinforced plate 41 for supporting the posts 61 of the loaded frame member 60 and can be fixed to the bottoms of the base frame 10 or the reinforced plate 41. Thereby, the corner support 43 of the invention can ensure the load of the frame member 60 and can prevent the loaded frame member 60 from being destroyed by a fork of forklift or another collisions. In another preferred embodiment of the present invention, the reinforced support 42 and the corner support 43 can be also integrally formed with the reinforced plate 41.

Now return back to the FIG. 2A, for each first side frame 20, the corner supports of post members is opposed to each other.

Figure 1A:
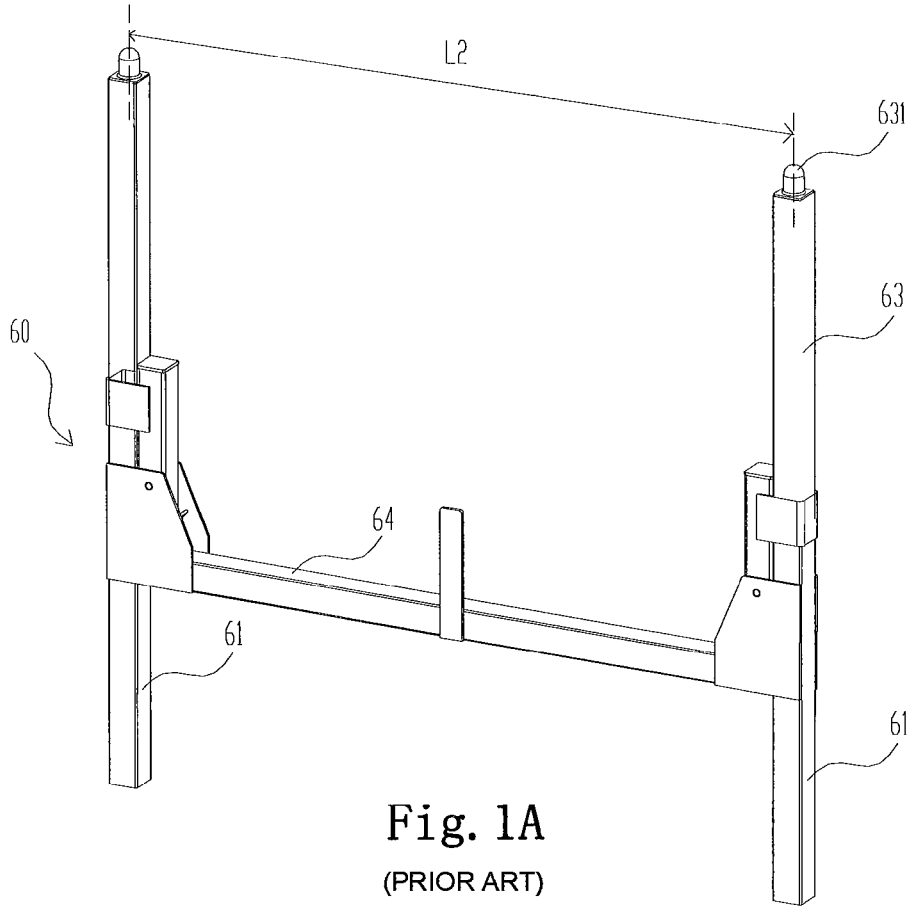
Fig. 1A (PRIOR ART)
FIG. 1A is a perspective view of a frame member in usage state of the prior art.
Figure 1B:
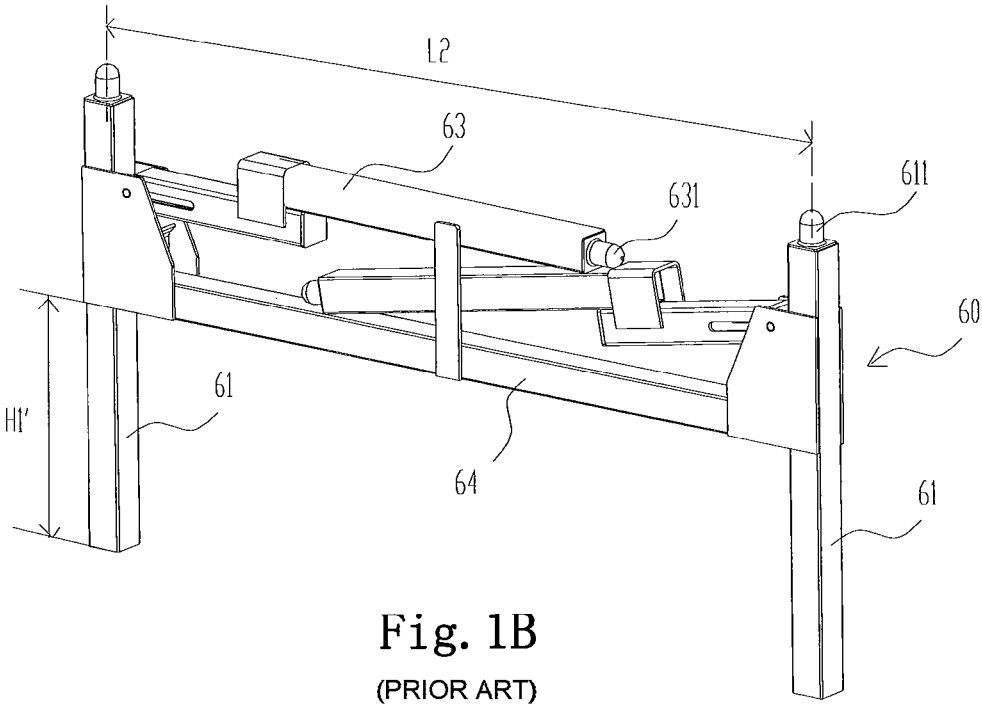
Fig. 1B (PRIOR ART)
FIG. 1B is another perspective view of a frame member in FIG. 1A, wherein the folding post is in the folded state.
Figure 2D:
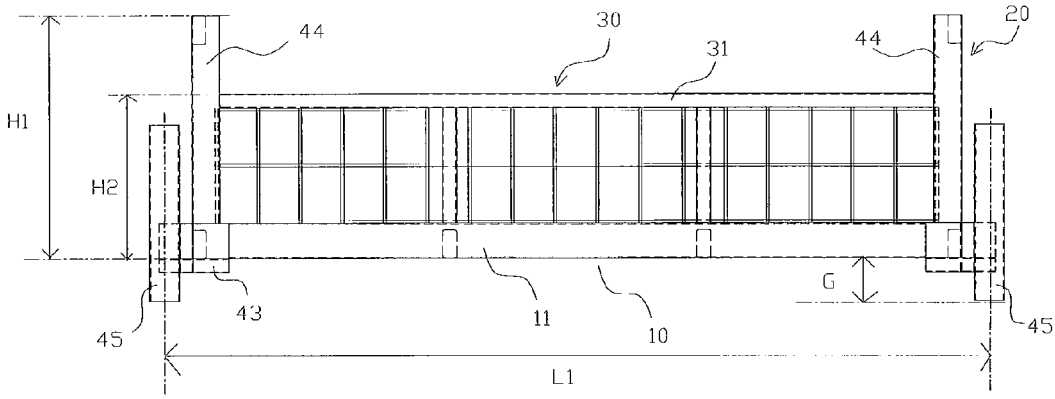
FIG. 2D is a side view of a pallet container in FIG. 2A, showing the first side frame.

According to the present invention, referring to FIG. 2D, the frame members 60 can be loaded on the post member 40 and the first side frame 20. Therefore, the center distance L1 of the two posts 45 should have the same length as that of the two post 61 (i.e., L2 as shown in FIG. 1B). Furthermore, the length H1' of a portion of the post 61 which is under the rail 64 is slightly shorter than or the same as the distance H1 between a top of the first side frame 20 and the corner support 43, i.e., the height of the first side frames. Additionally, the distance G between bottoms of the second post 45 and the base frame 10 is slightly longer than or the same to a thickness of a fork for a forklift (not shown), thereby it can be convenient for operation.

Figure 3A:
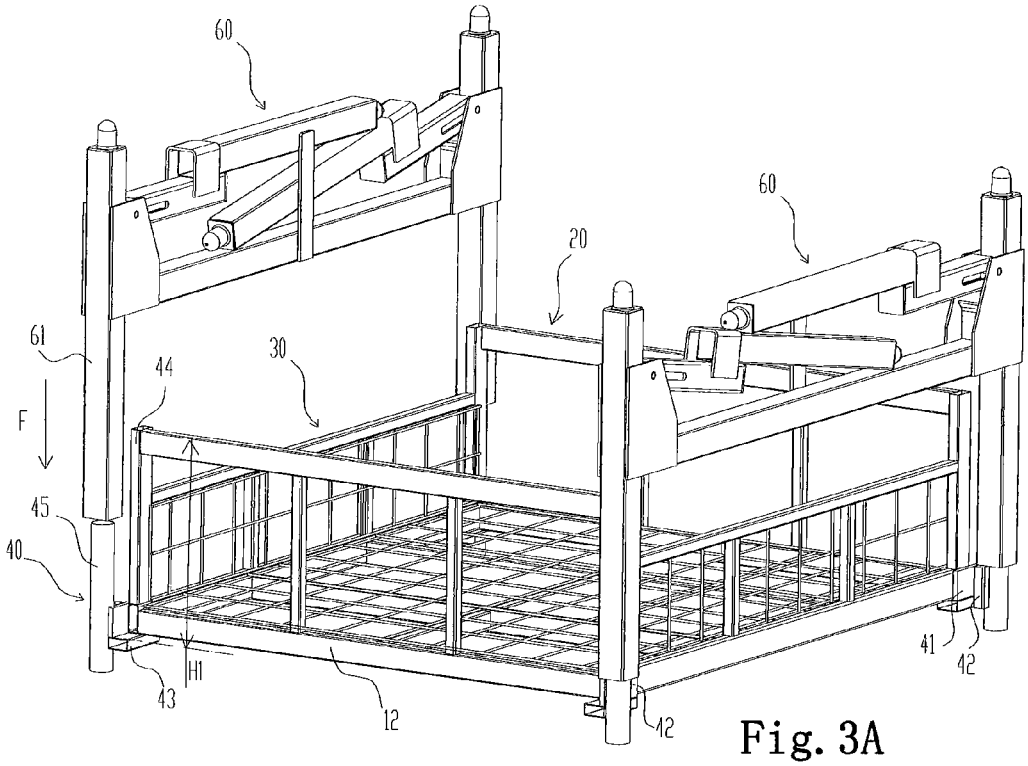
FIG. 3A is a perspective view of the pallet container in FIG. 2A, wherein the second post is loading with the frame member.
Figure 3B:
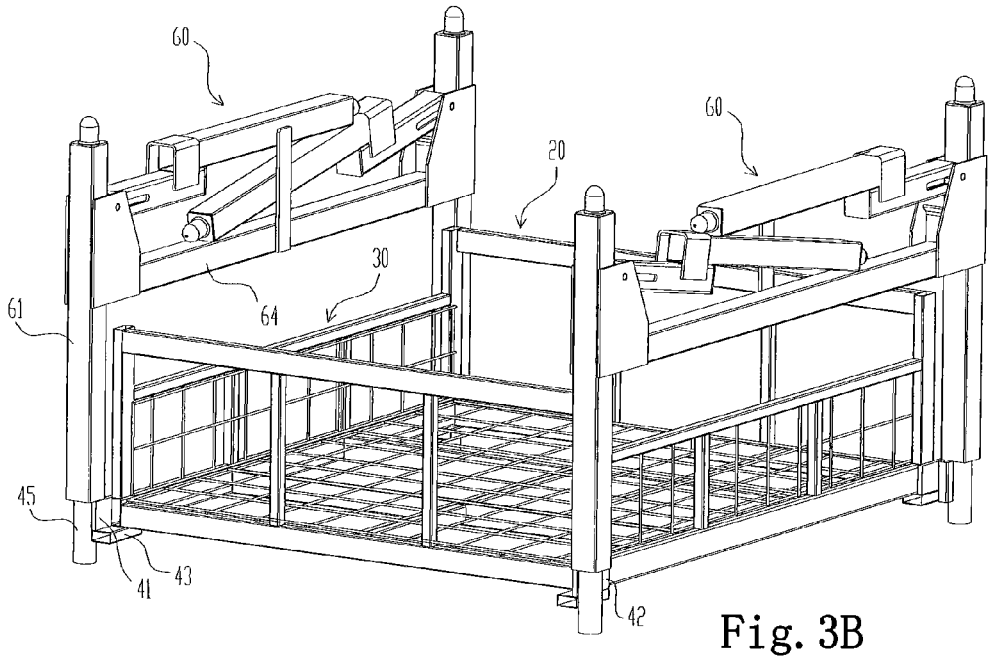
FIG. 3B is another perspective view of the pallet container in FIG. 2A showing the frame members are already loaded.

With reference to FIGS. 3A-3B, when transporting the frame member 60, firstly, the frame member 60 is loaded to the post members 40 in the direction of an arrow F by inserting the second post 45 into the post 61 of the frame member 60. By this way, the post 61 can be finally supported by the reinforced plate 41. After being loaded, the frame member 60 is stable as the reinforced support 42 and the reinforced plate 41 are of flushness.

Figure 3C:
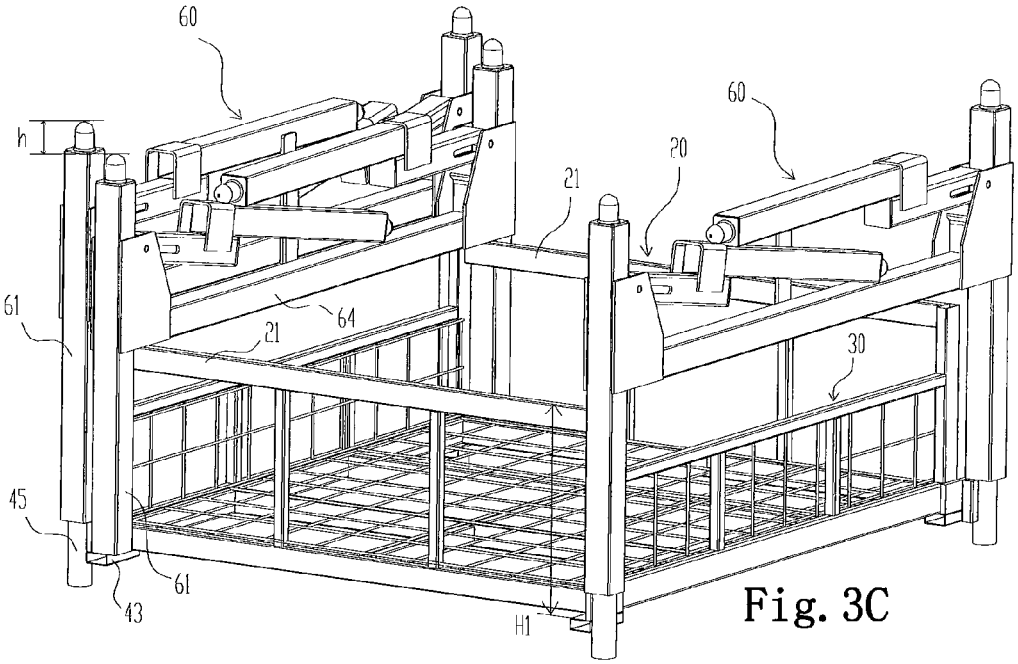
FIG. 3C is still another perspective view of the pallet container in FIG. 2A, showing the frame member is loaded along the first side frame.

The frame members 60 can be also loaded along the crossbeams 21 of the first side frame 20, as shown in FIG. 3C. The length H1' of a portion of the post 61 which is under the rail 64 (see FIG. 1B) is slightly shorter than or preferably as the same as the distance H1 between a top of the first side frame 20 and the corner support 43. Hence, the post 61 can be securely supported by the corner support 43 for safety transportation. Specially, the pair of the first side frames has a predetermined height so that a height of the frame member 60 loaded on the first side member 20 is less a height of the nesting 611 than that of one loaded to the second post 45.

Figure 3D:
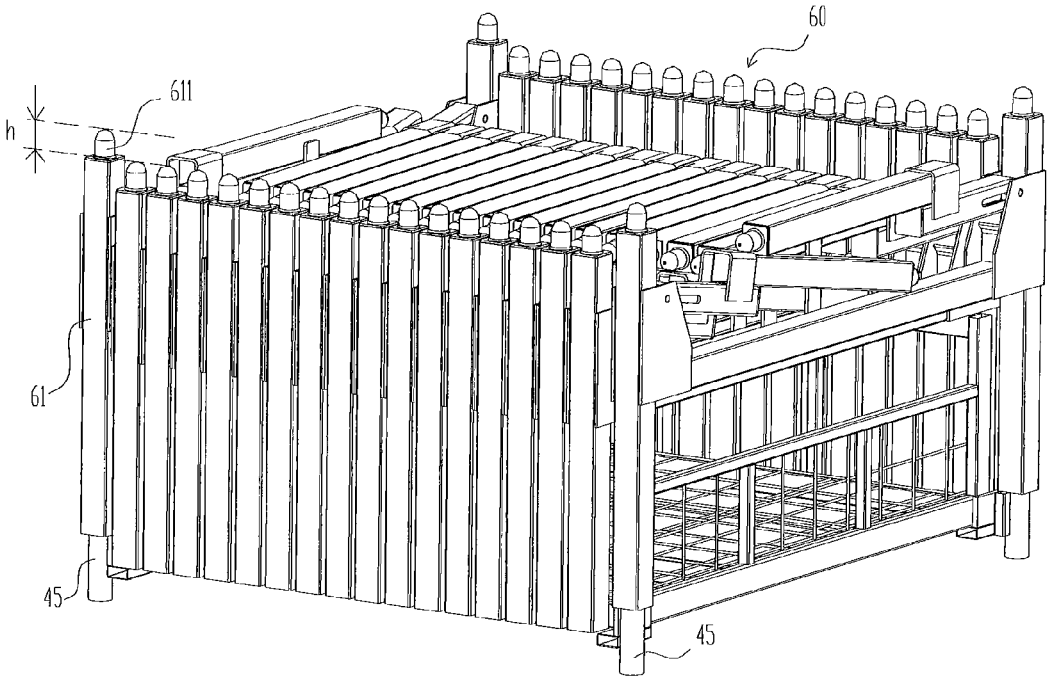
FIG. 3D is still another perspective view of the pallet container in FIG. 2A, fully loading the frame members.
Figure 4A:
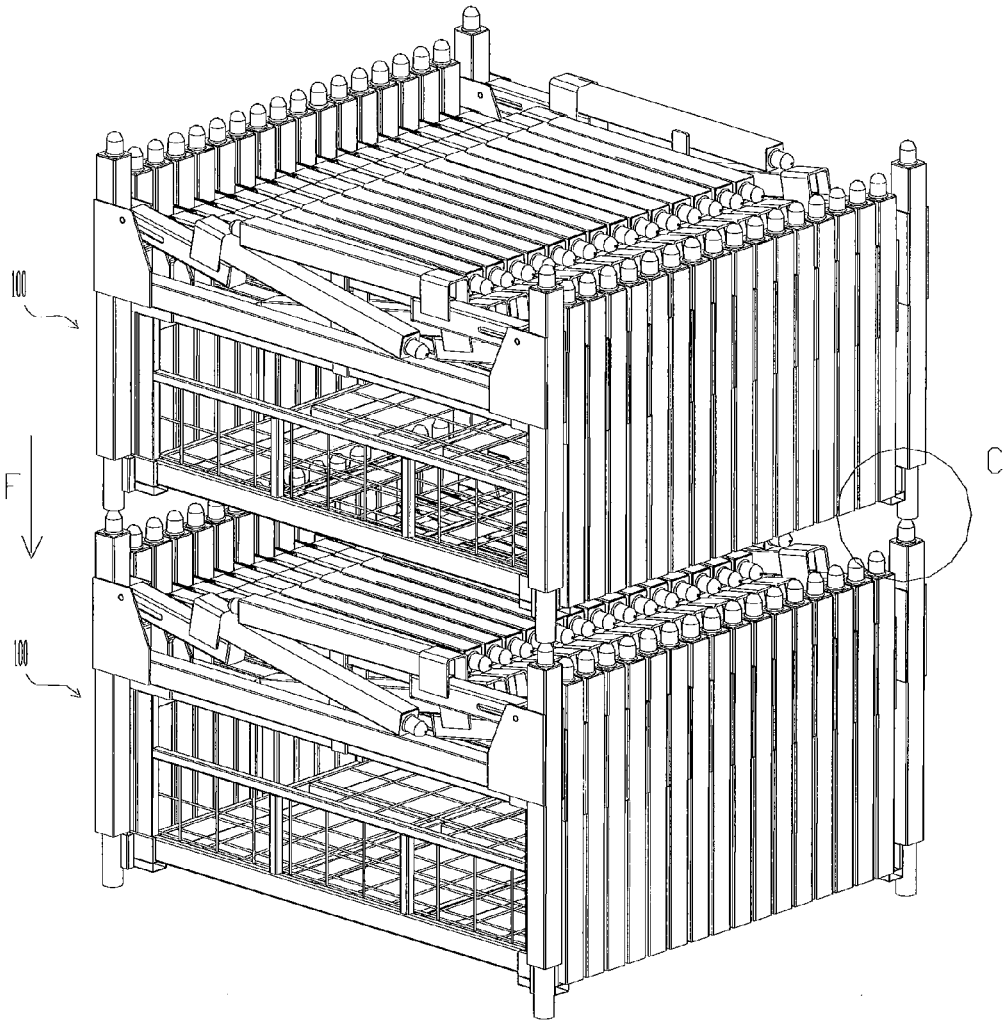
FIG. 4A is a perspective view of the pallet container in FIG. 3D being stacked.
Figure 4B:
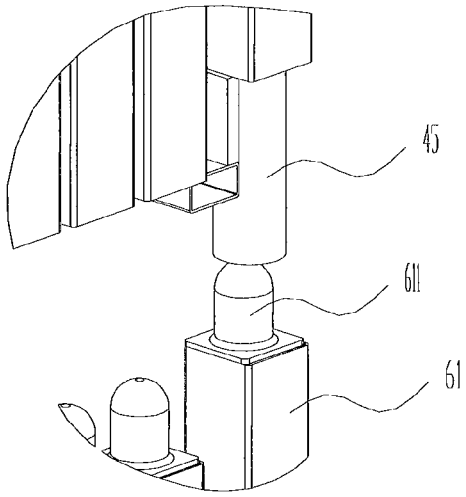
FIG. 4B is an enlarged perspective view of C part in FIG. 4A.
Figure 5:
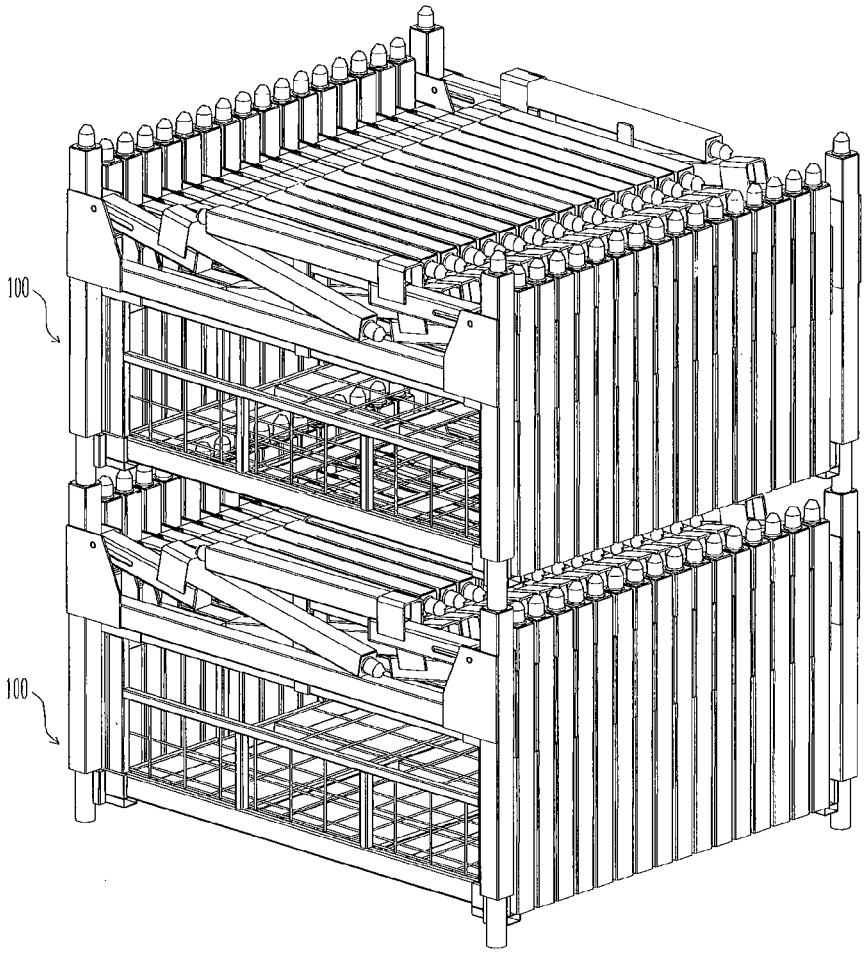
FIG. 5 is a perspective view of pallet containers in FIG. 3D in a stacked state

With reference to FIG. 3D, frame members 60 in alignment with each other are respectively mounted on the post member 40 and first side beams 20. In the preferred embodiment, the top of the reinforced plate 41 is high a height (h) of the nesting 611 over the corner support 43 so as to ensure the height of the frame member 60 loaded to the second post 45 is also higher a distance (h) than that of others. FIG. 4A shows that the pallet containers 100 of the invention fully loaded the frame members 60 is stocking in the direction of an arrow F. With reference to FIG. 4B, the stock for the pallet container 100 can be easily realized by inserting the nesting 611 of the frame member 61 loaded to the pallet container 100 in a lower position into the corresponding second post 45 of the pallet container 100 in a upper position. Thereby, two pallet containers 100 can be coupled to each other, as shown in FIG. 5. The pallet container 100 of the invention can be steadily superposed in the manner of efficiency. Additionally, spare parts can be placed into the pallet container 100 to fully utilize space. The posts 61 of the loaded frame members 60 are fully arranged along the first frames 20 of the invention, thus can also stop the cargoes from falling off the pallet container together with the baffle 82.

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A pallet container for transportation of loose cargoes, the loose cargoes including at least frame members, each of said frame members having a pair of posts spaced a predetermined distance and nestings provided thereof and a rail connected between middle portions of said pair of posts, wherein the pallet container comprises:

a base frame for loading cargoes, defined by longitudinal beams and crossbeams and having four sides;

two pairs of post members, provided at corners of the base frame, each post member comprising:

a first post, provided at a corner of the base frame and extended above the base frame; and a second post, spaced from the first post by a reinforced plate, into which the nesting is inserted;

a pair of first side frames for supporting the frame members, provided at two opposite sides of the base frame by the base frame and the first posts thereof, each of the first side frames comprises a crossbeam connected between two of the first posts for supporting the rail of the frame member so as to support said frame member;

a pair of second side frames provided at another two opposite sides of the base frame by the base frame and the first post thereof.

2. The pallet container as claimed in the claim 1, wherein center distance of the second posts of each pair of post members equals to that of the posts of frame members.

3. The pallet container as claimed in claim 2, wherein a reinforced support for reinforcing the second post is provided at one side of the reinforced plate.

4. The pallet container as claimed in claim 3, wherein the reinforced support is flush with the reinforced plate.

5. The pallet container as claimed in claim 4, wherein a corner support for supporting the post of frame member is defined under the reinforced plate and is further provided at the other side of the reinforced plate.

6. The pallet container as claimed in claim 5, wherein the corner supports of a pair of post members for each first side frame are opposed to each other.

7. The pallet container as claimed in claim 6, wherein the pair of first side frames has a predetermined height so that a height of the frame member loaded on the second pair of side frames is less a height of the nesting than that of one loaded on the second post.

8. The pallet container as claimed in claim 7, wherein a baffle for preventing the cargoes from falling off the base frame is provided on the pair of second side frames.

9. The pallet container as claimed in claim 8, wherein a distance of bottoms of the second post and the base frame is not less than a thickness of a fork of forklift.

* * * * *